US010968627B2

(12) United States Patent
Yu

(10) Patent No.: US 10,968,627 B2
(45) Date of Patent: Apr. 6, 2021

(54) STRUCTURE FOR BLOCKING HEAT TRANSFER THROUGH THERMAL BRIDGE OF BUILDING

(71) Applicant: Weiping Yu, Beijing (CN)

(72) Inventor: Weiping Yu, Beijing (CN)

( * ) Notice: Subject to any disclaimer, the term of this patent is extended or adjusted under 35 U.S.C. 154(b) by 0 days.

(21) Appl. No.: 16/858,706

(22) Filed: Apr. 26, 2020

(65) Prior Publication Data

US 2020/0263421 A1 Aug. 20, 2020

Related U.S. Application Data

(62) Division of application No. 15/324,758, filed on Jan. 9, 2017, now Pat. No. 10,676,924.

(51) Int. Cl.

| | |
|---|---|
| ***E04B 2/88*** | (2006.01) |
| ***E04B 1/78*** | (2006.01) |
| ***E04B 2/96*** | (2006.01) |
| *E06B 3/263* | (2006.01) |

(52) U.S. Cl.

CPC ..... *E04B 2/88* (2013.01); *E04B 1/78* (2013.01); *E04B 2/967* (2013.01); *E06B 3/26301* (2013.01)

(58) Field of Classification Search

CPC ..... E04B 2/88; E04B 2/967; E04B 2/8852; E04B 2/96; E04B 1/78; E06B 3/26301; E06B 3/221; E06B 3/5409; E06B 3/5427; E06B 3/56; E06B 2003/4453; E06B 3/26347

See application file for complete search history.

(56) References Cited

U.S. PATENT DOCUMENTS

| | | | | |
|---|---|---|---|---|
| 3,734,550 | A * | 5/1973 | Vance | E04B 2/965 403/34 |
| 4,024,690 | A * | 5/1977 | Collins | E06B 3/26347 52/204.591 |
| 5,452,552 | A * | 9/1995 | Ting | E06B 7/14 52/235 |
| 2002/0020121 | A1* | 2/2002 | Ishikawa | E04B 2/7455 52/127.2 |
| 2009/0241466 | A1* | 10/2009 | Gussakovsky | E06B 9/264 52/786.1 |

(Continued)

FOREIGN PATENT DOCUMENTS

| | | | | |
|---|---|---|---|---|
| DE | 2023820 | A1 * | 12/1971 | E06B 3/26347 |
| EP | 1225297 | A1 * | 7/2002 | E06B 3/163 |
| KR | 1020120126323 | A * | 11/2012 | E04B 2/96 |

*Primary Examiner* — Ryan D Kwiecinski
*Assistant Examiner* — Matthew J Gitlin

(57) ABSTRACT

A structure for blocking heat transfer through a thermal bridge of a building, includes an inner visual glass curtain wall, an outer visual glass curtain wall, an indoor metal frame, an outdoor metal frame, an outer decorative metal cover, a first thermal break strip, a second thermal break strip, a first nylon thermal break block and a second nylon thermal break block. The first thermal break strip, which is located in contact with the outdoor metal frame, the indoor metal frame, the first nylon thermal break block and the second nylon thermal break block, is an aerogel thermal insulation blanket. The second thermal break strip, which is located in contact with the indoor metal frame, the second nylon thermal break block, the outer decorative metal cover and the inner visual glass curtain wall, is another aerogel thermal insulation blanket.

1 Claim, 1 Drawing Sheet

(56) References Cited

U.S. PATENT DOCUMENTS

| | | | | |
|---|---|---|---|---|
| 2010/0139195 | A1* | 6/2010 | Tinianov | E06B 3/6715 52/309.13 |
| 2010/0293882 | A1* | 11/2010 | Labrecque | E04B 2/967 52/705 |
| 2014/0026510 | A1* | 1/2014 | Kubassek | E04B 1/40 52/512 |
| 2014/0208669 | A1* | 7/2014 | Weinryb | E06B 3/67326 52/172 |
| 2014/0325928 | A1* | 11/2014 | White | E04F 13/0805 52/506.05 |
| 2015/0315779 | A1* | 11/2015 | Baily | B32B 25/04 428/69 |
| 2016/0053494 | A1* | 2/2016 | White | E04B 1/40 52/698 |
| 2017/0362816 | A1* | 12/2017 | Carbary | E04F 13/0801 |
| 2019/0194939 | A1* | 6/2019 | Frederick | E04B 2/965 |

* cited by examiner

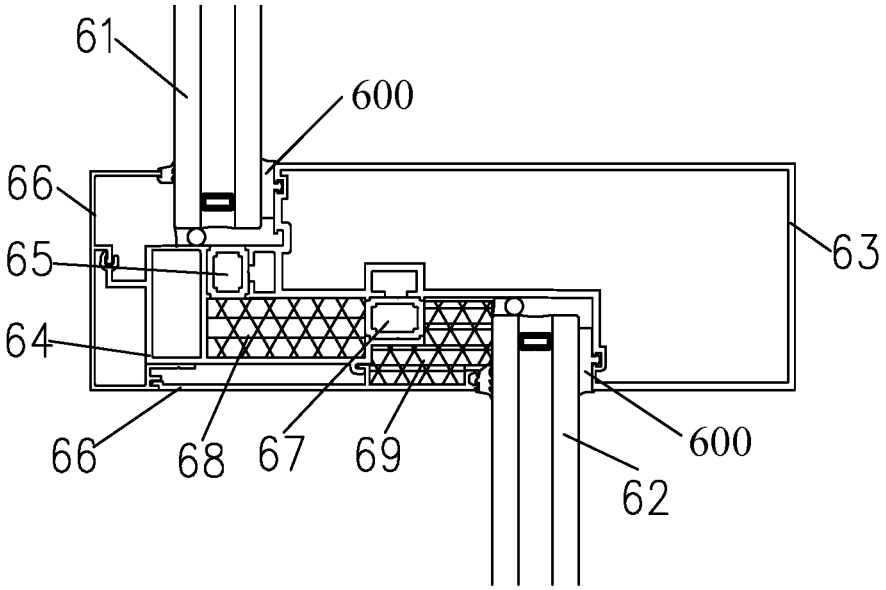
61
600
66
65
64
63
66
68
67
69
600
62

STRUCTURE FOR BLOCKING HEAT TRANSFER THROUGH THERMAL BRIDGE OF BUILDING

CROSS REFERENCE OF RELATED APPLICATION

This is a divisional application of U.S. patent application Ser. No. 15/324,758, filed Jan. 9, 2017.

BACKGROUND OF THE PRESENT INVENTION

Field of Invention

The present invention relates to a structure for blocking heat transfer in a building, and specifically to a structure for blocking heat transfer in a building.

Description of Related Arts

In the building with curtain walls, a thermal bridge, which is very difficult to be treated, is formed between an indoor metal frame and an outdoor metal frame or between an indoor metal frame and metal components, which causes great energy loss. In order to solve the above problem, the thermal break material must be installed between the indoor metal frame and the outdoor metal frame or between the indoor metal frame and the metal components. The space formed between the indoor metal frame and the outdoor metal frame or between the indoor metal frame and the metal components is usually very small and the thermal conductivities of existing thermal break materials are all about 0.25 W/(m·K), so the existing thermal break materials are unable to play a substantial effect in the given limited space, even if the materials have already been installed, the heat insulation performance of the curtain wall is unable to meet design requirements, and may cause the condensation problem in the interior of the curtain wall. On the contrary, in order to ensure the heat insulation performance, the existing curtain wall structure must be changed to reserve more space for the existing thermal break materials; which will reduce the adaptability of the existing curtain wall profiles, and increase the usage of the profiles and the cost of cutting new dies. In addition, the shape of the space formed between the indoor metal frame and the outdoor metal frame or between the indoor metal frame and the metal components is various and irregular, and the existing thermal break materials are mostly fixed shape products and are difficult to adapt various space structures, the frame of the curtain wall has to be designed in coordination with the shapes of the existing thermal break material products. Meanwhile, to meet the required heat insulation performance, there is a need to use several different types of the thermal break products so as to make up each other's shortage, thereby resulting in complex construction technology and poor structural strength. Furthermore, the combustion performance of the material used in the existing thermal break design is all fire rated B-class or below, so that it may be unsuitable for the curtain wall project with high fireproof and fire-resistant performance requirement. Also, the structure of the thermal break is usually that the thermal break material is held between the outdoor metal and the indoor metal, and the existing thermal break materials are usually regarded as the weak point and the security risk in the loading path of the structure.

SUMMARY OF THE PRESENT INVENTION

The present invention aims to overcome the above problems and provide a structure for blocking heat transfer through a thermal bridge of a building which has simple structure, convenient construction technology, great structural strength, excellent fireproof performance, low comprehensive construction cost and substantially improved energy-saving effect of the curtain wall.

To achieve the above object, the technical solution of the present invention is as follows. A structure for blocking heat transfer through a thermal bridge of a building comprises an inner visual glass curtain wall, an outer visual glass curtain wall, an indoor metal frame, an outdoor metal frame, an outer decorative metal cover, a first thermal break strip, a second thermal break strip, a first nylon thermal break block and a second nylon thermal break block, wherein: the first thermal break strip, which is located in contact with the outdoor metal frame, the indoor metal frame, the first nylon thermal break block and the second nylon thermal break block, is an aerogel thermal insulation blanket whose thermal conductivity is no greater than 0.021 W/(m·K); the second thermal break strip, which is located in contact with the indoor metal frame, the second nylon thermal break block, the outer decorative metal cover and the inner visual glass curtain wall, is another aerogel thermal insulation blanket whose thermal conductivity is no greater than 0.021 W/(m·K); the inner visual glass curtain wall is fixed to the indoor metal frame by structural silicone sealant, the outer visual glass curtain wall is fixed to the outdoor metal frame and the indoor metal frame by structural silicone sealant, the outer decorative metal cover is clamped on the outdoor metal frame, the outer visual glass curtain wall and the inner visual glass curtain wall; the outdoor metal frame is connected to the indoor metal frame by the first nylon thermal insulation block and the second nylon thermal insulation block.

After adopting the above solution, comparing to the prior art, since the first integral thermal break strip is installed between the indoor metal frame and the outdoor metal frame, the second integral thermal break strip is installed between the indoor metal frame, the outer decorative metal cover and the inner visual glass curtain wall, and the thermal conductivity of the first and the second thermal break strips both of which are embodied as the aerogel thermal insulation blanket is not higher than 0.021 W/(m·K), a thermal performance of the curtain wall is greatly enhanced, for ensuring that there is no condensation problem in an interior of the curtain wall, and a comprehensive construction cost of the curtain wall is decreased without changing frame profiles of the existing curtain wall design. A structure of the thermal break bridge is simplified, therefore the structure of the curtain wall is simplified and the construction is convenient to be well adapted to the cross-sectional shape with an advantage that the aerogel thermal insulation blanket is easy to be assembled, thereby forming an identical material, continuous and integral thermal break design, substantially improving energy-saving effect of the curtain wall. Furthermore, since the aerogel thermal insulation blanket is made of a thermal break material with fire rated A-class combustion performance, the fireproof and fire-resistant performance of the curtain wall is able to be better ensured.

The structure for blocking heat transfer through the thermal bridge of the building according to the present invention will be described in detail below in conjunction with the drawings.

BRIEF DESCRIPTION OF THE DRAWINGS

The drawing is a cross section view of a structure for blocking heat transfer through a thermal bridge of a building according to a preferred embodiment of the present invention, wherein the cross section view of the structure is a view along a horizontal direction of the building.

DETAILED DESCRIPTION OF THE PREFERRED EMBODIMENT

Referring to the drawing, a structure for blocking heat transfer through a thermal bridge of a building according to a preferred embodiment of the present invention is illustrated, which comprises an outer visual glass curtain wall 61, an inner visual glass curtain wall 62, an indoor metal frame 63, an outdoor metal frame 64, a metal component which is embodied as an outer decorative metal cover 66, a first thermal break strip 68, a second thermal break strip 69, a first nylon thermal insulation block 65 and a second nylon thermal insulation block 67.

Preferably, the indoor metal frame 63 and the outdoor metal frame 64 are both aluminum alloy frames. The outdoor metal frame 64 is connected to the indoor metal frame 63 by the first nylon thermal insulation block 65 and the second nylon thermal insulation block 67 with metal fasteners or buckles. The method for connecting both the outdoor metal frame 64 and the indoor metal frame 63 with the first nylon thermal insulation block 65 and the second nylon thermal insulation block 67 through the metal fasteners or buckles belongs to the prior art. The inner visual glass curtain wall 62 is fixed to the indoor metal frame 63 by structural silicone sealant 600 and the outer visual glass curtain wall 61 is fixed to the outdoor metal frame 64 and the indoor metal frame 63 by structural silicone sealant 600. The outer decorative metal cover 66 is an aluminum alloy decorative cover and is clamped on the outdoor metal frame 64, the outer visual glass curtain wall 61 and the inner visual glass curtain wall 62. The first thermal break strip 68, which is embodied as an aerogel thermal insulation blanket, is installed in contact with the outdoor metal frame 64, the indoor metal frame 63, the first nylon thermal insulation block 65 and the second nylon thermal insulation block 67. The second thermal break strip 69, which is embodied as another aerogel thermal insulation blanket, is installed in contact with the indoor metal frame 63, the second nylon thermal insulation block 67, the outer decorative metal cover 66 and the inner visual glass curtain wall 62. The commercially available aerogel thermal insulation blanket (Aerogel) is manufactured by Warmframe Corporation of China, Cabot Corporation and ASPEN Corporation of United States, with the thermal conductivity in a range of 0.015-0.021 W/(m·k).

The embodiment set forth above is only described as a preferred embodiment and is not intended to limit the scope of the present invention. It will be understood by those skilled in the art that various modifications and improvements to the technical solution of the present invention may be made without departing the design spirit of the present invention, which all fall into the scope as defined by the claims of the present invention.

PRACTICAL APPLICABILITY

The structure for blocking heat transfer through a thermal bridge of a building according to the present invention can save about 1.4 KWh of electricity per square meter in one year and also can save about 120 RMB of construction cost per square meter. There are total about 50 million square meters of new building projects every year in China, and about one percent of the buildings can use the structure of the present invention, so in one year the structure for blocking heat transfer through the thermal bridge of the building according to the present invention can save about 700 thousand KWh of electricity and 60 Million RMB of construction cost totally.

The structure for blocking heat transfer through the thermal bridge of the building according to the present invention has simple structure, convenient construction technology, great structural strength, excellent fireproof performance, low comprehensive construction cost and substantially improved energy-saving effect of the curtain wall.

What is claimed is:

1. A structure for blocking heat transfer through a thermal bridge of a building, which comprises: an inner visual glass curtain wall, an outer visual glass curtain wall, an indoor metal frame, an outdoor metal frame, an outer decorative metal cover, a first thermal break strip, a second thermal break strip, a first nylon thermal break block and a second nylon thermal break block, wherein:

the first thermal break strip, which is located in contact with the outdoor metal frame, the indoor metal frame, the first nylon thermal break block and the second nylon thermal break block, is an aerogel thermal insulation blanket whose thermal conductivity is no greater than 0.021 W/(m·K);

the second thermal break strip, which is located in contact with the indoor metal frame, the second nylon thermal break block, the outer decorative metal cover and the inner visual glass curtain wall, is another aerogel thermal insulation blanket whose thermal conductivity is no greater than 0.021 W/(m·K);

the inner visual glass curtain wall is fixed to the indoor metal frame by structural silicone sealant, the outer visual glass curtain wall is fixed to the outdoor metal frame and the indoor metal frame by structural silicone sealant, the outer decorative metal cover is clamped on the outdoor metal frame, the outer visual glass curtain wall and the inner visual glass curtain wall;

the outdoor metal frame is connected to the indoor metal frame by the first nylon thermal break block and the second nylon thermal break block.

* * * * *